US008479541B1

(12) United States Patent
Baily et al.

(10) Patent No.: US 8,479,541 B1
(45) Date of Patent: Jul. 9, 2013

(54) KNITTING NEEDLE WITH JOINTED TIP FOR LOOP RETENTION

(76) Inventors: Amy Elisabeth Baily, St. Louis, MO (US); Matthew Thomas Jenkins, Winnipeg (CA)

( * ) Notice: Subject to any disclaimer, the term of this patent is extended or adjusted under 35 U.S.C. 154(b) by 0 days.

(21) Appl. No.: 13/456,428

(22) Filed: Apr. 26, 2012

Related U.S. Application Data

(60) Provisional application No. 61/574,039, filed on Jul. 27, 2011.

(51) Int. Cl.
*D04B 35/02* (2006.01)

(52) U.S. Cl.
USPC ..... 66/117; 66/123

(58) Field of Classification Search
USPC ..... 66/117, 118, 1 A, 1 R, 123
See application file for complete search history.

(56) References Cited

U.S. PATENT DOCUMENTS

| | | | | | |
|---|---|---|---|---|---|
| 39,572 | A | * | 8/1863 | Hoadley | 66/118 |
| 51,115 | A | * | 11/1865 | Lamb | 66/121 |
| 162,412 | A | * | 4/1875 | Peberdy | 66/121 |
| 568,803 | A | * | 10/1896 | Seibel | 223/104 |
| 1,131,621 | A | * | 3/1915 | White | 66/118 |
| 1,261,853 | A | * | 4/1918 | Reece | 66/117 |
| 1,384,349 | A | | 7/1921 | Ross | |
| 1,401,728 | A | * | 12/1921 | Post | 66/117 |
| 1,496,579 | A | * | 6/1924 | Kraus | 66/117 |
| 1,523,918 | A | * | 1/1925 | Traum | 66/117 |
| 1,534,001 | A | * | 4/1925 | Blackman | 66/118 |
| 1,682,985 | A | | 9/1928 | Rollins | |
| 1,692,220 | A | | 11/1928 | Osberg | |
| 1,620,550 | A | | 3/1929 | Howe | |
| 1,709,631 | A | | 4/1929 | Schmidt | |
| 1,730,545 | A | | 10/1929 | Van Dyke | |
| 1,759,363 | A | | 5/1930 | Parlini | |
| 1,764,342 | A | | 6/1930 | Parlini | |
| 1,780,790 | A | | 11/1930 | Leavin et al. | |
| 1,823,906 | A | | 9/1931 | Leavin et al. | |
| 1,833,665 | A | | 11/1931 | Wagner | |
| 1,966,690 | A | | 7/1934 | Van Bergen | |
| 1,967,005 | A | | 7/1934 | Carlson | |
| 2,061,282 | A | | 11/1936 | Leboff et al. | |
| 2,234,061 | A | | 3/1941 | Porter et al. | |
| 2,248,341 | A | * | 7/1941 | Crumb | 66/117 |
| 2,252,302 | A | * | 8/1941 | Morith | 66/117 |
| 2,290,432 | A | * | 7/1942 | Hokstad | 66/117 |
| 2,309,528 | A | * | 1/1943 | Otting et al. | 66/117 |
| 2,418,417 | A | * | 4/1947 | Maillet | 66/117 |
| 2,439,622 | A | | 4/1948 | Howe | |
| 2,482,919 | A | * | 9/1949 | Lalanne et al. | 66/117 |
| 2,544,429 | A | | 6/1951 | Kadish et al. | |
| 2,596,311 | A | * | 5/1952 | Vitoux | 66/117 |
| 2,606,433 | A | * | 8/1952 | Bombonato | 66/117 |

(Continued)

*Primary Examiner* — Danny Worrell

(57) ABSTRACT

A knitting needle with a jointed tip is disclosed. The knitting needle comprises a shank having a first end comprising a protuberance and a second end having an upper portion and a lower portion. The upper and lower portions of the shank each configured to comprise a dip. The dips of the upper and lower portion configured to form a track wherein a tip may be coupled. The tip comprising a working end and a non-working end. A plurality of ridges runs along the non-working end of the tip. The ridges are configured to allow the non-working end to be coupled in the track formed by the dips of the upper and lower portions of the shank. The joint tip knitting needle may apply to single-pointed, double-pointed, circular, and/or cable knitting needles configurations.

24 Claims, 1 Drawing Sheet

U.S. PATENT DOCUMENTS 2,620,104 A * 12/1952 Graham ..... 223/102
2,718,131 A 9/1955 Black et al.
3,438,223 A * 4/1969 Linstead ..... 66/1 R
3,439,729 A 4/1969 Beighton et al.
3,603,115 A 9/1971 Elzey
3,701,462 A 10/1972 Riley
4,501,133 A * 2/1985 Kretzschmar et al. ..... 66/117
4,630,454 A * 12/1986 Seremjian ..... 66/1 A
D307,820 S 5/1990 Ullom et al.
5,537,844 A * 7/1996 MacLean ..... 66/117

* cited by examiner

KNITTING NEEDLE WITH JOINTED TIP FOR LOOP RETENTION

CROSS REFERENCE TO RELATED APPLICATION

This application claims priority to U.S. Provisional Application 61/574,039, filed on Jul. 27, 2011.

BACKGROUND OF THE INVENTION

1. Field of the Invention

The invention generally relates to a knitting needle with a jointed tip.

2. Description of Related Art

Prior art exists that discloses knitting needles with means to prevent material from falling off the tip end of the needle. The prior art also teaches knitting needles which allows a stopper to be placed through the tip to prevent material from falling off the end. There exists prior art which teaches a tip that is designed like a hook which can be closed to prevent material from falling off the end of the knitting needle. Prior art also teaches a knitting needle in which the tip may be detached and reattached to the opposite end of the shank to create a closed loop.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 1,384,349 to Ross describes a knitting needle along with a stopper which fits over the tip of the knitting needle to prevent material from falling off the end.

U.S. Pat. No. 1,496,579 to Kraus describes a knitting needle with a retainer device attached to the shank of the needle. The retainer may be left open when the needle is in operation and closed when not in use to keep material on the shank.

U.S. Pat. No. 1,833,665 to Wagner describes a knitting needle wherein the non-tip end of the shank may rotate perpendicular to the shank.

U.S. Pat. No. 1,966,690 to Bergen describes a circular knitting needle wherein the tip of each end may be inserted through a whole of the other tip to form a loop.

U.S. Pat. No. 2,234,061 to Porter et al. describes a knitting needle wherein the tip of the needle has a hole in which a stopper may be placed to prevent material from falling off.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant(s) will amend the specification to expressly recite the essential material that is incorporated by reference as allowed by the applicable rules.

BRIEF SUMMARY OF THE INVENTION

The present invention provides among other things a knitting needle with a jointed tip. When rotated such that the tip is in a parallel alignment with the shank, the knitting needle functions as a normal knitting needle. When the tip is rotated such that it is perpendicular to the shank, the tip acts as a stopper to prevent material from falling off the knitting needle.

In the present embodiment, a knitting needle comprises a shank, an articulating tip, and a protuberance. One end of the shank comprises an upper and a lower portion. The upper and lower portion of the shank each has a dip. The dip of the upper and lower portion configured to form a track wherein the tip may be coupled. The tip comprises a working and a non-working end. A plurality of ridges runs along the non-working end of the tip. The plurality of ridges may be configured to allow the non-working end of the tip to be coupled to the track formed by the dips of the upper and lower portions of the shank. The dip of the upper portion may be formed in substantially the same location as the dip of the lower portion. The protuberance may be substantially ball shaped. The plurality of ridges of the non-working end of the tip configured to hold the tip in place when rotated perpendicular to the shank. The tip may be configured to be coupled to a single-pointed knitting needle.

The present invention provides among other things a knitting needle with a jointed tip. The knitting needle comprises a shank having a first and a second end, where the first and second ends each comprise an upper and a lower portion. The upper and lower portions of the shank each configured to have a dip. The dips of the upper and lower portion configured to form a track where a tip may be coupled. The tip comprises a working and a non-working end. A plurality of ridges runs along the non-working end of the tip. The ridges may be configured to allow the non-working end of the tip to be coupled to the track formed by the dip of the upper and lower portions of the first and second end of the shank. The plurality of ridges of the non-working end of the tip configured to hold the tip in place when rotated perpendicular to the shank. In the present invention, the tip may be configured to be coupled to the ends of a double-pointed, circular, or cable knitting needle.

The present invention provides among other things a jointed tip for knitting needles. The tip comprises a working and a non-working end. The non-working end comprises a plurality of ridges configured to allow the tip to be coupled to the end of a knitting needle. The plurality of ridges configured to allow the tip to rotate along an axis relative to the shank of a knitting needle. The plurality of ridges may also configured to prevent the tip from rotating back into a parallel alignment with the shank. The jointed tip may be configured to be coupled to the end of a single-pointed, double-pointed, circular, or cable knitting needle.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar.

Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

While prior art teaches knitting needles that contain tips configured to stop material from falling off the ends, the present invention offers advantages over the prior art. First, when the jointed tip is placed in a parallel alignment with the shank, it appears and operates as a regular knitting needle. Unlike some prior art, which changes the structure of the tip of the needle, a user would not have to adjust to using a new knitting needle. Second, some prior art discloses the insertion of an object into the tip as a way to stop material from falling off. The knitting needle disclosed here does not require additional modifications to the tip to prevent material from falling off as a user would simply have to rotate the tip into a perpendicular alignment with the shank to accomplish that. Third, the knitting needle disclosed here does not require the use of a removable tip where the tip may be removed after use and replaced with a "stopper" tip when work is completed.

Figure 1:
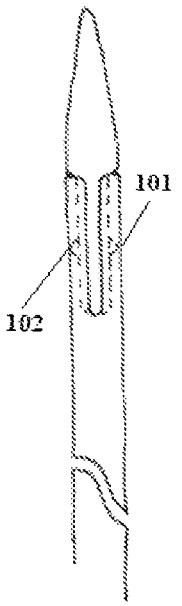
FIG. 1 depicts a side-elevation view of an implementation of a jointed needle tip in a closed position.
Figure 2:
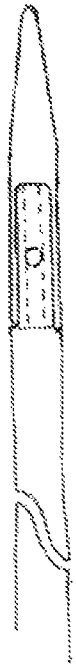
FIG. 2 depicts a front view of an implementation of a jointed needle tip in a closed position.
Figure 3:
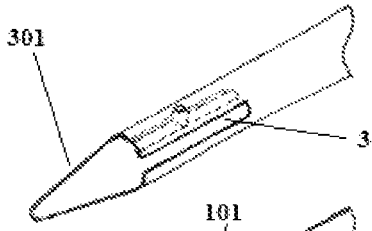
FIG. 3 depicts an isometric view of an implementation of a jointed needle tip in a closed position.
Figure 4:
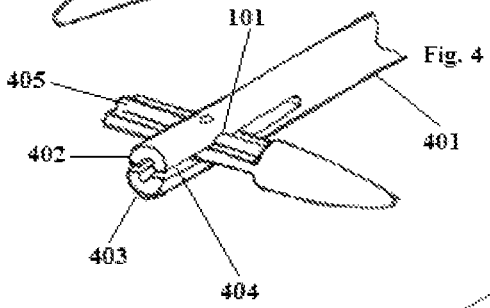
FIG. 4 depicts an isometric view of an implementation of a jointed needle tip in a open position.
Figure 5:
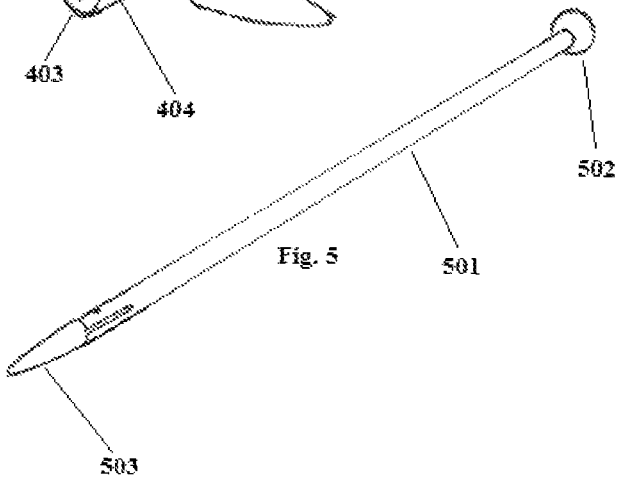
FIG. 5 depicts an isometric view of an implementation of a single-pointed knitting needle with a jointed tip.

In one embodiment, the knitting needle may be applied to a single-pointed knitting needle as shown in FIG. 5. The knitting needle may comprise a shank 501, a protuberance 502, and a tip 503. One end of the shank may comprise a protuberance 502 in the form of a ball. The protuberance 502 may be configured to prevent yarn from falling off the end of the shank 501 when the knitting needle is in use. The other end 401 of the shank 501 may comprise an upper 402 and a lower portion 403 as shown in FIG. 4. The upper portion 402 and lower portion 403 may each have a dip 101, 102, respectively. The dips 101, 102 may be configured to form a track 404 wherein the tip 503 may be coupled. The dips 101, 102 of the upper 402 and lower portions 403 are formed in substantially the same location on each portion such that when facing each other, the dips 101, 102 align to form a track 404. The tip 503 may comprise a working 301 and a non-working end 302. The working end 301 of the tip 503 may act as a normally functioning knitting needle tip, allowing a user to thread yarn when the tip is configured in a parallel alignment with the shank 501 as shown in FIG. 3. The non-working end 302 of the tip may comprise a plurality of ridges 405, the plurality of ridges 405 may be configured to allow the non-working end 302 to be coupled within the track formed by the dips 101, 102 of the lower and upper section of the shank 501 as shown in FIG. 5.

In other embodiments, the tip may be held in place between the upper and lower portion of the shank using a rivet, screw, rod, or any other device configured to allow the tip to rotate within the track formed. In other embodiments, the protuberance at the end of the shank may comprise a shape other than a ball. Such other shapes may include various other geometric shapes as long as the circumference or width of the protuberance is greater than that of the shank to prevent material from falling off the end.

In one embodiment, when the tip is coupled to the shank, the tip may rotate within the track formed by the upper and lower sections of the shank as shown in FIG. 4. When the tip is rotated such that the tip is perpendicular to the shank, the ridges 405 of the non-working end 302 may hold the tip in place between the dips 101, 102 of the upper 402 and lower 403 section to prevent the tip from reverting back to being in a parallel alignment with the shank.

In other embodiments, the tip is not limited to being used for a single-pointed knitting needle. The tip may be used on double-pointed, circular, or cable knitting needles depending on the user's preference. The functionality of the tip remains the same regardless of the type of knitting needle it is applied to.

In other embodiments, a stopper material may be fully enclosed within the shank of the needle. The stopper material may be extended outwardly from the shank while the tip remains in a parallel alignment with the shank to prevent material from falling off the end of the shank. The stopper material may promise a plurality of geometric shapes configured to fit within a shank and is configured to prevent material from falling off the end.

Additionally, the various components of implementations of the knitting needles disclosed herein may be comprised of plastic, metal, wood, or any other appropriate material. All or some of the components comprising the knitting needle may be discrete components or may be formed of a continuous piece of material.

We claim:

1. A knitting needle comprising:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension;

a first tip portion extending along a longitudinal dimension from a non-pointed end to a pointed end and having a transverse dimension being perpendicular to said longitudinal dimension, said transverse dimension extending between two opposite external surfaces of said first tip portion along a second length extending between said two opposite surfaces, said second length being substantially smaller at said pointed end of said first tip portion than at said non-pointed end of said first tip portion, said second length at said non-pointed end of said first tip portion being substantially the same as said first length at said end of said shank portion; and a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions.

2. The knitting needle of claim 1 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, the shank portion extending away from said end along said longitudinal dimension to a second end having a protuberance affixed thereto.

3. The knitting needle of claim 1 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, the shank portion extending away from said end along said longitudinal dimension to a second end having one or more tip portions other than the first tip portion or the second tip portion affixed thereto.

4. The knitting needle of claim 1 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, the shank portion having one or more external surfaces of a cylinder.

5. The knitting needle of claim 1 wherein a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions comprises:

a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is the substantially unaligned with said longitudinal dimension of said first and second tip portions as said shank portion being substantially perpendicular with said longitudinal dimension of said first and second tip portions.

6. The knitting needle of claim 1 wherein a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions comprises:

a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is the substantially unaligned with said longitudinal dimension of said first and second tip portions as said first tip portion extending away from a first portion of the shank portion and the second tip portion extending away from a second portion of the shank portion opposite the first portion of the shank portion.

7. The knitting needle of claim 1 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, the shank portion extending away from said end along said longitudinal dimension to a second end having a cable affixed thereto.

8. A knitting needle comprising:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension;

a first tip portion extending along a longitudinal dimension from a non-pointed end to a pointed end and having a transverse dimension being perpendicular to said longitudinal dimension, said transverse dimension extending between two opposite external surfaces of said first tip portion along a second length extending between said two opposite surfaces, said second length being substantially smaller at said pointed end of said first tip portion than at said non-pointed end of said first tip portion, said second length at said non-pointed end of said first tip portion being substantially the same as said first length at said end of said shank portion; and a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions, said second tip portion sized to fit in said gap of said shank portion when said second tip portion is in said first position.

9. The knitting needle of claim 8 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including the gap located between said two opposite external surfaces extending from said end along a portion of said length of said shank portion along said longitudinal dimension being bounded by surfaces containing one or more ridges running along said longitudinal dimension of said shank portion.

10. The knitting needle of claim 8 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including the gap located between said two opposite external surfaces extending from said end along a portion of said length of said shank portion along said longitudinal dimension being bounded by surfaces containing one or more grooves running along said longitudinal dimension of said shank portion.

11. The knitting needle of claim 8 wherein a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions, said second tip portion sized to fit in said gap of said shank portion when said second tip portion is in said first position comprises:

a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions, said second tip portion sized to fit in said gap of said shank portion when said second tip portion is in said first position, said second tip portion having on or more grooves running along said longitudinal dimension of said second tip portion to mate with one or more surfaces of said gap.

12. The knitting needle of claim 8 wherein a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions, said second tip portion sized to fit in said gap of said shank portion when said second tip portion is in said first position comprises:

a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions, said second tip portion sized to fit in said gap of said shank portion when said second tip portion is in said first position, said second tip portion having one or more ridges running along said longitudinal dimension of said second tip portion to mate with one or more surfaces of said gap.

13. The knitting needle of claim 8 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension, the shank portion extending away from said end along said longitudinal dimension to a second end having a protuberance affixed thereto.

14. The knitting needle of claim 8 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension, the shank portion extending away from said end along said longitudinal dimension to a second end having one or more tip portions other than the first tip portion or the second tip portion affixed thereto.

15. The knitting needle of claim 8 wherein a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension comprises:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension, said shank portion including a gap located between said two opposite external surfaces extending from said end along a portion of said length of said shank portion along said longitudinal dimension, the shank portion having one or more external surfaces of a cylinder.

16. The knitting needle of claim 8 wherein a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions, said second tip portion sized to fit in said gap of said shank portion when said second tip portion is in said first position comprises:

a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is the substantially unaligned with said longitudinal dimension of said first and second tip portions being substantially perpendicular with said longitudinal dimension of said first and second tip portions.

17. The knitting needle of claim 8 wherein a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is substantially unaligned with said longitudinal dimension of said first and second tip portions, said second tip portion sized to fit in said gap of said shank portion when said second tip portion is in said first position comprises:

a second tip portion being integral with said first tip portion, said second tip portion extending along said longitudinal dimension of said first tip portion away from said non-pointed end of said first tip portion in a direction opposite of said pointed end of said first tip portion, said second tip portion being movably joined to said shank portion allowing for movement of said first and second tip portions relative to said shank portion between a first position where said longitudinal dimension of said shank portion is substantially in alignment with said longitudinal dimension of said first and second tip portions and said non-pointed end of said first tip portion juxtaposes said end of said shank portion and a second position where said longitudinal dimension of said shank portion is the substantially unaligned with said longitudinal dimension of said first and second tip portions as said first tip portion extending away from a first portion of the shank portion and the second tip portion extending away from a second portion of the shank portion opposite the first portion of the shank portion.

18. A knitting needle comprising:

a shank portion extending along a longitudinal dimension to an end and having a transverse dimension being perpendicular to said longitudinal dimension, said transverse dimension extending between two opposite external surfaces of said shank portion along a first length between said two opposite external surfaces, said first length substantially unvarying for each position along said longitudinal dimension; and a tip portion extending along a longitudinal dimension from a non-pointed portion to a pointed end and having a transverse dimension being perpendicular to said longitudinal dimension, said transverse dimension extending between two opposite external surfaces of said tip portion along a second length extending between said two opposite surfaces, said second length being substantially smaller at said pointed end of said tip portion than at said non-pointed portion of said tip portion, said second length at said non-pointed portion of said tip portion being substantially the same as said first length at said end of said shank portion, said tip portion being movably joined to said shank portion allowing for movement of said tip portion relative to said shank portion between a first position where said longitudinal dimension of said shank portion is substantially in alignment with said longitudinal dimension of said tip portion and said non-pointed portion of said first tip portion juxtaposes said end of said shank portion and a second position where said longitudinal dimension of said shank portion is substantially unaligned with said longitudinal dimension of said tip portion.

19. The knitting needle of claim 18 wherein a tip portion extending along a longitudinal dimension from a non-pointed portion to a pointed end and having a transverse dimension being perpendicular to said longitudinal dimension, said transverse dimension extending between two opposite external surfaces of said tip portion along a second length extending between said two opposite surfaces, said second length being substantially smaller at said pointed end of said tip portion than at said non-pointed portion of said tip portion, said second length at said non-pointed portion of said tip portion being substantially the same as said first length at said end of said shank portion, said tip portion being movably joined to said shank portion allowing for movement of said tip portion relative to said shank portion between a first position where said longitudinal dimension of said shank portion is substantially in alignment with said longitudinal dimension of said tip portion and said non-pointed portion of said first tip portion juxtaposes said end of said shank portion and a second position where said longitudinal dimension of said shank portion is substantially unaligned with said longitudinal dimension of said tip portion comprises:

a tip portion extending along a longitudinal dimension from a non-pointed portion to a pointed end and having a transverse dimension being perpendicular to said longitudinal dimension, said transverse dimension extending between two opposite external surfaces of said tip portion along a second length extending between said two opposite surfaces, said second length being substantially smaller at said pointed end of said tip portion than at said non-pointed portion of said tip portion, said second length at said non-pointed portion of said tip portion being substantially the same as said first length at said end of said shank portion, said tip portion being the movably joined to said shank portion allowing for movement of said tip portion relative to said shank portion between a first position where said longitudinal dimension of said shank portion is substantially in alignment with said longitudinal dimension of said tip portion and said non-pointed portion of said first tip portion juxtaposes said end of said shank portion and a second position where said longitudinal dimension of said shank portion is substantially unaligned with said longitudinal dimension of said tip portion being rotatably joined.

20. The knitting needle of claim 18 wherein a tip portion extending along a longitudinal dimension from a non-pointed portion to a pointed end and having a transverse dimension being perpendicular to said longitudinal dimension, said transverse dimension extending between two opposite external surfaces of said tip portion along a second length extending between said two opposite surfaces, said second length being substantially smaller at said pointed end of said tip portion than at said non-pointed portion of said tip portion, said second length at said non-pointed portion of said tip portion being substantially the same as said first length at said end of said shank portion, said tip portion being movably joined to said shank portion allowing for movement of said tip portion relative to said shank portion between a first position where said longitudinal dimension of said shank portion is substantially in alignment with said longitudinal dimension of said tip portion and said non-pointed portion of said first tip portion juxtaposes said end of said shank portion and a second position where said longitudinal dimension of said shank portion is substantially unaligned with said longitudinal dimension of said tip portion comprises:

a tip portion extending along a longitudinal dimension from a non-pointed portion to a pointed end and having a transverse dimension being perpendicular to said longitudinal dimension, said transverse dimension extending between two opposite external surfaces of said tip portion along a second length extending between said two opposite surfaces, said second length being substantially smaller at said pointed end of said tip portion than at said non-pointed portion of said tip portion, said second length at said non-pointed portion of said tip portion being substantially the same as said first length at said end of said shank portion, said tip portion being movably joined to said shank portion allowing for movement of said tip portion relative to said shank portion between a first position where said longitudinal dimension of said shank portion is substantially in alignment with said longitudinal dimension of said tip portion and said non-pointed portion of said first tip portion juxtaposes said end of said shank portion and a second position where said longitudinal dimension of said shank portion is the substantially unaligned with said longitudinal dimension of said tip portion as said first portion of said tip portion extending away from a first portion of the shank portion and a second portion of said tip portion extending away from a second portion of the shank portion opposite the first portion of the shank portion.

21. A knitting needle comprising:

a shank portion extending along a first longitudinal dimension to an end; and a tip portion extending along a second longitudinal dimension from a non-pointed portion to a pointed end, said tip portion movably joined with said shank portion to allow for positioning between a first position where said tip portion is being movably engaged with said shank portion forming a structure with substantial alignment between said first longitudinal dimension and said second longitudinal dimension and with a transverse dimension perpendicular to said first and second longitudinal dimensions, said transverse dimension with substantially unvarying length between opposite external surfaces of said structure along a first portion of said first and second longitudinal dimensions and substantially continuously decreasing length along remaining of said first and second longitudinal dimensions to said pointed end, and between a second position where said longitudinal dimension of said shank portion is substantially unaligned with said longitudinal dimension of said tip portion.

22. The knitting needle of claim 21 wherein a tip portion extending along a second longitudinal dimension from a non-pointed portion to a pointed end, said tip portion movably joined with said shank portion to allow for positioning between a first position where said tip portion is being movably engaged with said shank portion forming a structure with substantial alignment between said first longitudinal dimension and said second longitudinal dimension and with a transverse dimension perpendicular to said first and second longitudinal dimensions, said transverse dimension with substantially unvarying length between opposite external surfaces of said structure along a first portion of said first and second longitudinal dimensions and substantially continuously decreasing length along remaining of said first and second longitudinal dimensions to said pointed end, and between a second position where said longitudinal dimension of said shank portion is substantially unaligned with said longitudinal dimension of said tip portion comprises:

a tip portion extending along a second longitudinal dimension from a non-pointed portion to a pointed end, said tip portion movably joined with said shank portion to allow for positioning between a first position where said tip portion is being said movably engaged with said shank portion forming a structure with substantial alignment between said first longitudinal dimension and said second longitudinal dimension and with a transverse dimension perpendicular to said first and second longitudinal dimensions, said transverse dimension with substantially unvarying length between opposite external surfaces of said structure along a first portion of said first and second longitudinal dimensions and substantially continuously decreasing length along remaining of said first and second longitudinal dimensions to said pointed end, and between a second position where said longitudinal dimension of said shank portion is the substantially unaligned with said longitudinal dimension of said tip portion being rotatably joined.

23. The knitting needle of claim 21 wherein a tip portion extending along a second longitudinal dimension from a non-pointed portion to a pointed end, said tip portion movably joined with said shank portion to allow for positioning between a first position where said tip portion is being movably engaged with said shank portion forming a structure with substantial alignment between said first longitudinal dimension and said second longitudinal dimension and a with transverse dimension perpendicular to said first and second longitudinal dimensions, said transverse dimension with substantially unvarying length between opposite external surfaces of said structure along a first portion of said first and second longitudinal dimensions and substantially continuously decreasing length along remaining of said first and second longitudinal dimensions to said pointed end, and between a second position where said longitudinal dimension of said shank portion is substantially unaligned with said longitudinal dimension of said tip portion comprises:

a tip portion extending along a second longitudinal dimension from a non-pointed portion to a pointed end, said tip portion movably joined with said shank portion to allow for positioning between a first position where said tip portion is being movably engaged with said shank portion forming a structure with substantial alignment between said first longitudinal dimension and said second longitudinal dimension and with a transverse dimension perpendicular to said first and second longitudinal dimensions, said transverse dimension with substantially unvarying length between opposite external surfaces of said structure along a first portion of said first and second longitudinal dimensions and substantially continuously decreasing length along remaining of said first and second longitudinal dimensions to said pointed end, and between a second position where said longitudinal dimension of said shank portion is the substantially unaligned with said longitudinal dimension of said tip portion as a first portion of said tip portion extending away from said first portion of said shank portion and a second portion of said tip portion extending away from a second portion of said shank portion opposite from said first portion of said shank portion.

24. A knitting needle comprising:

a shank portion extending along a first longitudinal dimension to an end; and a tip portion extending along a second longitudinal dimension from a non-pointed portion to a pointed end, said tip portion movably joined with said shank portion to allow for positioning between a first position where said tip portion is movably engaged with said shank portion forming a structure with substantial alignment between said first longitudinal dimension and said second longitudinal dimension, and between a second position where said longitudinal dimension of said shank portion is substantially unaligned with said longitudinal dimension of said tip portion as a first portion of said tip portion extends away from said shank portion in a first direction and a second portion of said tip portion extends away from said shank portion in a second direction opposite from said first direction.

* * * * *